US007489083B2

(12) United States Patent
Homma et al.

(10) Patent No.: US 7,489,083 B2
(45) Date of Patent: Feb. 10, 2009

(54) MERCURY-FREE ARC TUBE FOR DISCHARGE BULB

(75) Inventors: Akira Homma, Shizuoka (JP); Takeshi Fukuyo, Shizuoka (JP); Michio Takagaki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 433 days.

(21) Appl. No.: 11/443,360

(22) Filed: May 31, 2006

(65) Prior Publication Data

US 2006/0267501 A1 Nov. 30, 2006

(30) Foreign Application Priority Data

May 31, 2005 (JP) ..... P. 2005-158647

(51) Int. Cl.
*H01J 17/20* (2006.01)
*H01J 61/16* (2006.01)
*H01J 61/12* (2006.01)

(52) U.S. Cl. ..... 313/643; 313/637; 313/568; 313/570

(58) Field of Classification Search ..... 313/568, 313/570, 623, 631, 637, 643
See application file for complete search history.

(56) References Cited

U.S. PATENT DOCUMENTS

| | | | | |
|---|---|---|---|---|
| 6,853,140 | B2 * | 2/2005 | Lapatovich et al. | 313/637 |
| 2004/0150343 | A1 * | 8/2004 | Takahashi et al. | 313/623 |
| 2005/0122047 | A1 * | 6/2005 | Kato et al. | 313/631 |

FOREIGN PATENT DOCUMENTS

| | | | |
|---|---|---|---|
| JP | 6-20645 | A | 1/1994 |
| JP | 2001-357818 | A | 12/2001 |
| JP | 2004-63158 | A | 2/2004 |

* cited by examiner

*Primary Examiner*—Toan Ton
*Assistant Examiner*—Bumsuk Won
(74) *Attorney, Agent, or Firm*—Sughrue Mion, PLLC

(57) ABSTRACT

The arc tube is provided with a mercury-free arc tube main body that has a discharge light-emitting portion (closed glass sphere), and a cylindrical shroud glass tube that is airtightly integrated with the arc tube main body. In the mercury-free arc tube in which an inert gas is sealed in the shroud glass tube that surrounds the closed glass sphere, in the shroud glass tube, the adjustment is made so as to satisfy the light flux and the life span with respect to the pressure X (atmospheric pressure) of a rare gas sealed in the closed glass sphere, and an amount M (mg/ml) of sealed metal halide.

4 Claims, 6 Drawing Sheets

FIG. 3

(AMOUNT OF SEALED METAL HALIDE 20mg/ml)

| | | | Xe | Ar | Ar:N2 | Ar:Ne | N2 | Ar:Ne | Ar:Ne | Ar:Ne | Xe:Ne |
|---|---|---|---|---|---|---|---|---|---|---|---|
| | RATIO | ——— | 100% | 100% | 5:5 | 8:2 | 100% | 5:5 | 4:6 | 3:7 | 2:8 |
| | THERMAL CONDUCTIVITY | ——— | 0.016 | 0.044 | 0.054 | 0.057 | 0.064 | 0.077 | 0.084 | 0.090 | 0.091 |
| 10atm | INITIAL LIGHT FLUX | n=15 | 2848 | 2687 | 2500 | | 2450 | 2224 | | | 2036 |
| | LIFE SPAN TIME | n=4 | 1983 | 2532 | 2711 | | 2805 | 3067 | | | 3110 |
| 12.5atm | INITIAL LIGHT FLUX | n=15 | 3107 | 2843 | 2666 | 2689 | 2612 | 2440 | 2350 | 2202 | 2168 |
| | LIFE SPAN TIME | n=4 | 1845 | 2248 | 2563 | 2412 | 2555 | 2640 | 2878 | 3027 | 2876 |
| 15atm | INITIAL LIGHT FLUX | n=15 | 3450 | 3111 | 3020 | | 2885 | 2663 | | | 2448 |
| | LIFE SPAN TIME | n=4 | 1640 | 1995 | 2210 | | 2313 | 2522 | | | 2648 |

FIG. 5

(AMOUNT OF SEALED METAL HALIDE 10mg/ml)

| | | | Xe | Ar | Ar:N2 | Ar:Ne | N2 | Ar:Ne | Ar:Ne | Ar:Ne | Xe:Ne |
|---|---|---|---|---|---|---|---|---|---|---|---|
| | RATIO | ——— | 100% | 100% | 5:5 | 8:2 | 100% | 5:5 | 4:6 | 3:7 | 2:8 |
| | THERMAL CONDUCTIVITY | ——— | 0.016 | 0.044 | 0.054 | 0.057 | 0.064 | 0.077 | 0.084 | 0.090 | 0.091 |
| 10atm | INITIAL LIGHT FLUX | n=15 | 2698 | 2465 | 2268 | | 2231 | 2001 | | | 1887 |
| | LIFE SPAN TIME | n=4 | 2505 | 3021 | 3105 | | 3299 | 3579 | | | 3619 |
| 12.5atm | INITIAL LIGHT FLUX | n=15 | 2887 | 2625 | 2562 | 2465 | 2433 | 2207 | 2101 | 1967 | 1921 |
| | LIFE SPAN TIME | n=4 | 2278 | 2834 | 2873 | | 3110 | 3167 | | | 3458 |
| 15atm | INITIAL LIGHT FLUX | n=15 | 3239 | 2908 | 2839 | | 2568 | 2514 | | | 2258 |
| | LIFE SPAN TIME | n=4 | 2130 | 2538 | 2650 | | 2746 | 3028 | | | 3108 |

| | | Xe PRESSURE | THERMAL CONDUCTIVITY |
|---|---|---|---|
| 20mg/ml | UPPER LIMIT (LIGHT FLUX) | 10.0 | 0.067 |
| | | 12.5 | 0.081 |
| | | 15.0 | 0.100 |
| | LOWER LIMIT (LIFE SPAN) | 15.0 | 0.078 |
| | | 12.5 | 0.060 |
| | | 10.0 | 0.044 |
| | | 10.0 | 0.067 |

| | | Xe PRESSURE | THERMAL CONDUCTIVITY |
|---|---|---|---|
| 10mg/ml | UPPER LIMIT (LIGHT FLUX) | 10.0 | 0.050 |
| | | 12.5 | 0.065 |
| | | 15.0 | 0.086 |
| | LOWER LIMIT (LIFE SPAN) | 15.0 | 0.042 |
| | | 12.5 | 0.027 |
| | | 10.0 | 0.013 |
| | | 10.0 | 0.050 |

MERCURY-FREE ARC TUBE FOR DISCHARGE BULB

The present application claims foreign priority based on Japanese Patent Application No. P.2005-158647, filed on May 31, 2005, the contents of which are incorporated herein by reference.

BACKGROUND OF THE INVENTION

1. Field of the Invention

The present invention relates to an arc tube which for ms a main portion of a discharge bulb that is used for a light source of a vehicle headlamp or the like. More particularly, the present invention relates to a mercury-free arc tube for a discharge bulb in which mercury is not contained in a closed glass sphere that serves as a discharge light-emitting portion of the arc tube.

2. Related Art

Generally, a discharge bulb has been used for a light source of a vehicle headlamp or the like. For example, as disclosed in JP-A-06-020645, this kind of discharge bulb has a structure in which it includes an arc tube main body having a closed glass sphere that serves as a discharge light-emitting portion in which electrodes are oppositely provided, and a cylindrical shroud glass tube that is airtightly integrated with the arc tube main body so as to surround the closed glass sphere. In the cylindrical shroud glass tube that surrounds the closed glass sphere, air (or nitrogen) is sealed (filled).

In addition, in the discharge bulb, mercury, together with an inert gas and metal halides, is generally sealed in the closed glass sphere of the arc tube main body so as to increase a light-emitting efficiency, as is also described in JP-A-06-020645. In recent years, however, there has been a heightened social need for reducing the use of mercury, which is an environmentally harmful substance. As a result, a so-called mercury-free arc tube has been developed in which mercury is not sealed in a closed glass sphere.

If mercury is sealed in the closed grass sphere, it is possible to obtain high vapor pressure even at a low temperature in comparison with other metals, ant the mercury acts as a thermal buffer with respect to a tube wall of the arc tube in the surroundings of the arc formed between the electrodes. However, in the mercury-free arc tube, since mercury does not exist (that is, a thermal buffering function of mercury does not exist), the temperature of the tube wall of the arc tube undesirably becomes high. Then, in the mercury-free arc tube, the heat of the closed glass sphere serving as the discharge light-emitting portion is transmitted to the shroud glass tube through the air surrounding the closed glass sphere (or nitrogen), so that the heat loss becomes large correspondingly. Thus, there is a problem in that a light-emitting efficiency of the arc tube becomes lowered.

In addition, since the surface temperature of the shroud glass tube rises due to the heat transfer from the closed glass sphere serving as the discharge light-emitting portion, there is another problem in that silicon gas or the like in a lighting device becomes attached to the surface of the shroud glass tube, and thus the shroud glass becomes whitened.

Accordingly, as described in JP-A-2004-063158, in order to resolve the above-mentioned problems (in that a light-emitting efficiency of the arc light source becomes lowered, and the shroud glass tube becomes whitened), sealed is gas that contains any one of Ar, Kr, and Xe, each having relatively lower thermal conductivity than air, by at least 50% in the shroud glass tube that surrounds the closed glass sphere, such that the thermal conductivity is remarkably lowered in a heat insulating space around the closed glass sphere formed by the shroud glass tube.

In the mercury-free arc tube of JP-A-2004-063158, the above-mentioned problems, in that a light-emitting efficiency of the arc tube becomes lowered and the shroud glass tube becomes whitened, are resolved, because the thermal conductivity is remarkably lowered in a heat insulating space around the closed glass sphere formed by the shroud glass tube surrounding the closed glass sphere. However, since the thermal conductivity is markedly lowered in the heat insulating space around the closed glass sphere formed by the shroud glass tube surrounding the closed glass sphere, the temperature in the closed glass sphere excessively rises, and flickering (flickering of arc) occurs with devitrification of an inner wall. As a result, a life span of the arc tube becomes shortened, which results in lowering performance.

Further, a maximum value of an outer diameter the shroud glass tube is regulated in a standard (ECER99). So, an inner diameter of the shroud grass cannot be large, since some inner thickness of the glass of the shroud grass is necessary in order to ensure the strength. In addition, since the closed glass sphere becomes a high temperature, it is necessary to increase an outer diameter of the closed glass sphere so as to ensure durability of the closed glass sphere. Therefore, the gap between the closed glass sphere and the shroud glass tube is set to 1 mm or less in a conventional discharge bulb.

The mercury-free arc tube is manufactured in a state in which a center axis of the shroud glass tube aligns with a discharge axis between electrodes (hereinafter, referred to as discharge axis). However, in the process of manufacturing the arc tube, the center axis and the discharge axis of the shroud glass tube may not accurately align with each other, and thus may deviate from each other (the gap around the closed glass sphere is not uniform in a circumferential direction). In addition, the arc tube, in which the center axis and the discharge axis of the shroud glass tube deviate from each other, is installed in the insulating plug unit so as to form the discharge bulb. When the discharge axis deviates from the center axis of the shroud glass tube in a downward direction of the center axis (when the center axis of the closed glass sphere deviates downward from the center axis of the shroud glass tube, and thus the minute gap $\delta 1$ between the shroud glass tube and a lower portion of the closed glass sphere is smaller than the minute gap $\delta 2$ between the shroud glass tube and an upper portion of the closed glass sphere), there is a problem in that the light flux of the arc tube becomes lowered. The reason why the light flux of the arc tube becomes lowered is considered as follows. That is, in the large heat insulating space above the closed glass sphere (minute gap $\delta 2$), the heat propagation from the closed glass sphere to the shroud glass tube is suppressed. In contrast, in the small heat insulating space below the closed glass sphere (minute gap $\delta 1$), the heat propagation from the closed glass sphere to the shroud glass tube is accelerated. As a result, since radiation of the heat is accelerated from the lower region of the shroud glass tube, the temperature of the cold point in the closed glass sphere rises and the vapor pressure rises, which results in increasing a light flux.

SUMMARY OF THE INVENTION

One or more embodiments of the present invention provide a mercury-free arc tube which is capable of adjusting a thermal conductivity of an inert gas sealed in a shroud glass tube surrounding a closed glass sphere with a predetermined value on the basis of a pressure of starting rare gas sealed in the closed glass sphere and an amount of sealed metal halide, so as to achieve an excellent initial characteristic and an excellent performance during operation.

In accordance with one or more embodiments of the present invention, a mercury-free arc tube for a discharge bulb is provided with: a mercury-free arc tube main body that has a closed glass sphere which serves as a discharge light-emitting portion in which electrodes are oppositely provided and starting rare gases and metal halides are sealed; and a cylindrical shroud glass tube that is airtightly integrated with arc tube main body and surrounds the closed glass sphere, and an inert gas is sealed in the shroud glass tube surrounding a closed glass sphere. In the shroud glass tube, a first inert gas of any one of Ar, Kr, and Xe, each of which has relatively low thermal conductivity, and a second inert gas of any one of He and Ne, each of which has relatively high thermal conductivity, are mixed with each other, and a mixed gas is sealed in which the thermal conductivity λ(W/m·K) is adjusted so as to satisfy the condition $(X+0.42M-12)/160 \leqq \lambda \leqq (X+0.32M-6.5)/144$ with respect to a pressure X (atmospheric pressure) of starting rare gas sealed in the closed glass sphere and an amount M of sealed metal halide (mg/ml), the pressure of starting rare gas sealed in the closed glass sphere X being within a range of 10 to 15 atm, the amount M of sealed metal halide being within a range of 10 to 20 mg/ml.

According to the mercury-free arc tube of the embodiments, in the shroud glass tube which surrounds the closed glass sphere, the inert gas in which the thermal conductivity is adjusted to a predetermined value is sealed, so that the heat propagation from the closed glass sphere to the shroud glass tube is suppressed. Further, when the pressure of sealed starting rare gas is less than 10 atm, the initial light flux, which is necessary for the light source of the headlamp, is not obtained, and when the pressure of sealed starting rare gas exceeds 15 atm, the crack may occur in the closed glass sphere when being turned on. However, according to the mercury-free arc tube of the embodiments, the pressure X of starting rare gas sealed in the closed glass sphere is within a range of 10 to 15 atm, and the amount M of sealed metal halide is within a range of 10 to 20 mg/ml. Therefore, the required initial light flux can be obtained, and the crack does not occur.

Further, the thermal conductivity of the inert gas sealed in the shroud glass tube and the life span of the arc tube are in direct proportion to each other (the thermal conductivity of the inert gas and the light flux are in inverse proportion to each other), and the amount of the metal halide sealed in the closed glass sphere and the life span of the arc tube are in inverse proportion to each other (the amount of the metal halide and the light flux are in direct proportion to each other). However, in the mercury-free arc tube of the embodiments, since the thermal conductivity λ(W/m·K) of the mixed gas is adjusted to satisfy the formula of $$(X+0.42M-12)/160 \leqq \lambda \leqq (X+0.32M-6.5)/144$$

with respect to the pressure X (atmospheric pressure) of the starting rare gas sealed in the closed glass sphere and an amount M (mg/ml) of the sealed metal halide, the light flux of 2350 lumens or more and the life span of 2500 hours or more are ensured.

In addition, since the thermal conductivity λ(W/m·K) of the mixed gas is adjusted to satisfy the formula of $$(X+0.42M-12)/160 \leqq \lambda \leqq (X+0.32M-6.5)/144,$$

the sealed inert gas prevents the heat propagation from the closed glass sphere serving as the discharge light-emitting portion to the shroud glass tube, prevents that the thermal loss is excessive, and the-light-emitting efficiency of the arc tube becomes lowered, and prevents that the surface temperature of the shroud glass tube excessively rises, and the surface becomes whitened.

Moreover, since the thermal conductivity λ(W/m·K) of the mixed gas is adjusted to satisfy the formula of $$(X+0.42M-12)/160 \leqq \lambda < (X+0.32M-6.5)/144$$

the sealed inert gas properly controls the heat propagation from the sealed glass sphere serving as the discharge light-emitting portion to the shroud glass tube and causes (allows) the heat to be properly irradiated through the shroud tube, so that the occurrence of the flickering is prevented due to the excessive rise of the temperature in the closed glass sphere.

In addition, the first inert gas whose thermal conductivity is relatively low is mixed with the second inert gas whose thermal conductivity is relatively high, so that the thermal conductivity λ(W/m·K) of the inert gas sealed in the shroud glass tube at the time of operation is adjusted on the formula. Therefore, the thermal conductivity of the mixed gas can be accurately and easily adjusted to predetermined thermal conductivity, as compared from cases, when a single inert gas is mixed with the air or nitrogen, when a plurality of kinds of inert gases each of which has relatively lower thermal conductivity are mixed with each other, and when a plurality of kinds of inert gases each of which has relatively higher thermal conductivity are mixed with each other.

Further, in accordance with one or more embodiments of the present invention, in the mercury-free arc tube, a minute gap δ1 between a lower portion of the closed glass sphere and the shroud glass tube and a minute gap δ2 between an upper portion of the closed glass sphere and the shroud glass tube may satisfy the condition δ1>δ2.

Therefore, as compared with a case of the minute gap δ1< the minute gap δ2, the heat propagation is suppressed in the small heat insulating space below the closed glass sphere (minute gap δ1), and the radiation of the heat is suppressed from the lower region of the shroud glass tube. As a result, the temperature of the cold point in the closed glass sphere rises and the vapor pressure rises, which results in rising a light flux.

In addition, since the arc generated between the electrodes curves upward, thermal expansion increases at the upper side of the closed glass sphere which becomes high temperature. In a mercury-contained arc tube in which the mercury is sealed in the closed glass sphere, since the inside of the closed glass sphere becomes high temperature even at the low temperature, so that, in a case of δ1>δ2, the upper portion of the expanded closed glass sphere may interfere with the shroud glass tube and may be broken. However, since the pressure of the inside of the closed glass sphere of the mercury-free arc tube is about half the pressure of the inside of the closed glass sphere of the mercury-contained arc tube, even though, for example, the minute gaps satisfy the condition δ1>δ2, there is no concern in that the upper portion of the closed glass sphere interferes with the shroud glass tube and breakage occurs.

In the mercury-free arc tube according to the embodiments, the thermal conductivity of the inert gas, which is sealed in the shroud glass tube surrounding the closed glass sphere, is set to a predetermined value capable of ensuring the predetermined light flux and the life span on the basis of the pressure of starting rare gas sealed in the closed gas sphere and the amount of sealed metal halide. Therefore, it is possible to obtain a mercury-free arc tube having an excellent initial characteristic and an excellent performance characteristic.

In particular, since the thermal conductivity of the inert gas sealed in the shroud glass tube can be easily and correctly adjusted, a mercury-free arc tube, which has excellent initial characteristic and performance characteristic, can be manufactured at a low cost.

In addition, when the gap between the lower portion of the closed glass sphere and the shroud glass tube is the same as or larger than the gap between an upper portion of the closed glass sphere and the shroud glass tube, the heat radiation from the lower region of the shroud glass tube is suppressed, and the maximum cooling point temperature in the closed glass sphere rises. Therefore, it is possible to provide a discharge bulb having a mercury-free arc tube in which a light flux is increased.

Other aspects and advantages of the invention will be apparent from the following description and the appended claims.

BRIEF DESCRIPTION OF THE DRAWINGS

FIG. 3 is a diagram illustrating a relationship among the thermal conductivity of an inert gas sealed in a shroud glass tube, an initial light flux, and a life span in a state in which an amount of metal halide sealed in a closed glass sphere is 20 mg/ml.

FIG. 4(*b*) is a graph illustrating the relationship of FIG. 3, and illustrating a relationship between the thermal conductivity of the inert gas sealed in the shroud glass tube and the initial light flux.

FIG. 5 is a diagram illustrating a relationship among the thermal conductivity of an inert gas sealed in a shroud glass tube, an initial light flux, and a life span in a state in which an amount of metal halide sealed in the closed glass sphere is 10 mg/ml.

FIG. 6(*b*) is a graph illustrating the relationship of FIG. 5, and illustrating a relationship between the thermal conductivity of the inert gas sealed in the shroud glass tube and the initial light flux.

FIG. 7(*b*) is a diagram illustrating an upper limit and a lower limit of the thermal conductivity of an inert gas sealed in the shroud glass tube when an amount of metal halide sealed in the closed glass sphere is 10 mg/ml.

FIG. 7(*c*) is a diagram illustrating a range of thermal conductivity of an inter gas sealed in the shroud glass tube where the light flux and life span of the arc tube become predetermined values for practical use.

DETAILED DESCRIPTION OF THE EXEMPLARY EMBODIMENTS

Exemplary embodiments of the invention will be described with reference to the accompanying drawings.

Figure 1:
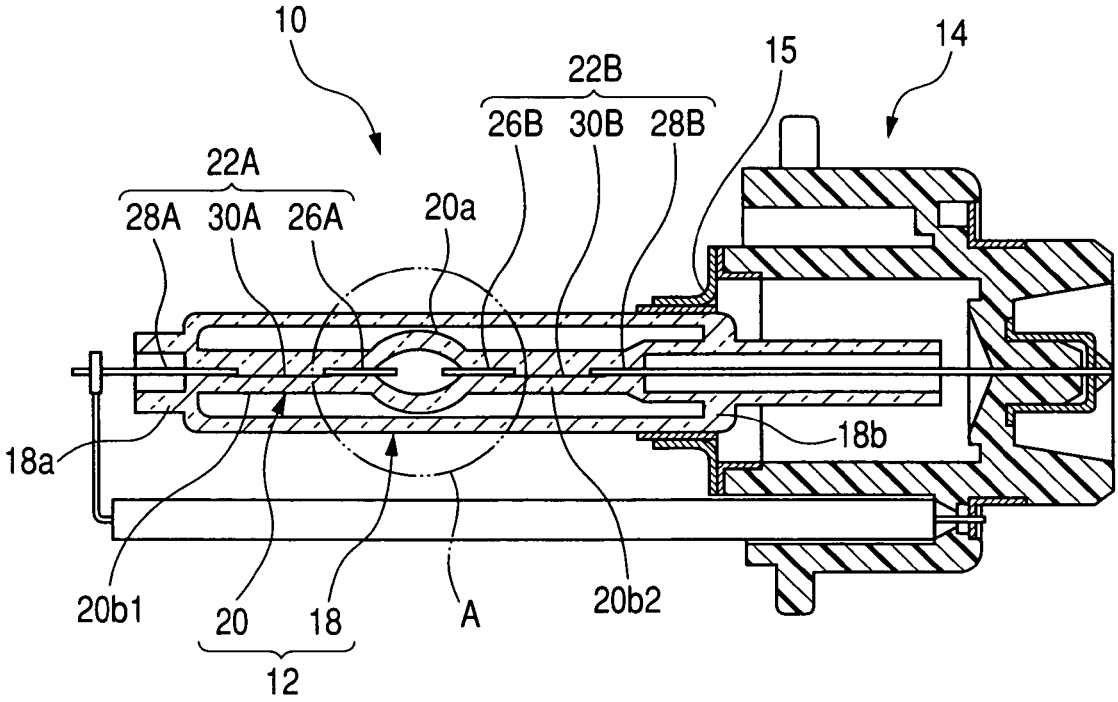
FIG. 1 is a longitudinal cross-sectional view of a discharge bulb according to an exemplary embodiment of the invention.
Figure 2:
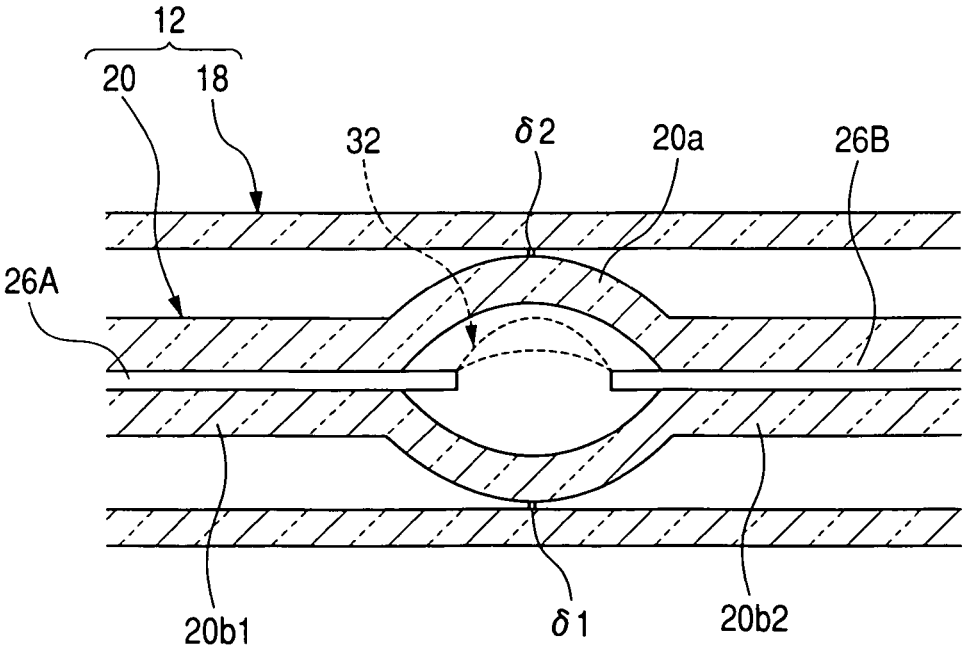
FIG. 2 is an enlarged longitudinal cross-sectional view illustrating a portion of an arc tube which is a main portion of the discharge bulb (enlarged view of a main portion shown by reference character A of FIG. 1).

FIGS. 1 and 2 are diagrams illustrating a discharge bulb according to an exemplary embodiment of the invention. Specifically, FIG. 1 is a longitudinal cross-sectional view of the discharge bulb, and FIG. 2 is an enlarged longitudinal cross-sectional view illustrating a portion of an arc tube which is a main portion of the same discharge bulb (enlarged view of a main portion shown by reference character A in FIG. 1).

In FIGS. 1 and 2, a discharge bulb 10 is a light source bulb that is mounted on a vehicle headlamp. The discharge bulb 10 includes an arc tube 12 that extends in a cross direction, and an insulating plug unit 14 that fixedly supports a rear end portion of the arc tube 12. Reference numeral 15 indicates a fixedly supporting member that is made of a metallic material. The fixedly supporting member fixedly supports a periphery of the rear end side of the arc tube 12 to the insulating plug unit 14.

The arc tube 12 has a structure in which an arc tube main body 20 is integrated with shroud glass tube 18 that cylindrically surrounds the arc tube main body 20. The arc tube main body 20 has a structure in which an elongated cylindrical quartz glass tube is machined, and a pair of electrode assemblies 22A and 22B are integrally buried in a cross direction. At a substantially center portion of the arc tube main body 20 in a longitudinal direction, a closed glass sphere 20*a* is formed which serves as a discharge light-emitting portion in which electrodes 26A and 26B are oppositely provided. At both sides of the closed glass sphere 20*a* in a cross direction, pinch sealing portions 20*b*1 and 20*b*2 ate formed.

The electrode assembly 22A has a structure in which a rod-shaped electrode 26A (which is made of tungsten) and a leading line 28A (which is made of molybdenum) are fixedly connected to each other through a metallic foil 30A (which is made of molybdenum), and the electrode assembly 22B has a structure in which a rod-shaped electrode 26B (which is made of tungsten) and a leading line 28B (which is made of molybdenum) are fixedly connected to each other through a metallic foil 30B (which is made of molybdenum). In the respective pinch sealing portions 20*b*1 and 20*b*2 , the respective electrode assemblies 22A and 22B are pinch-sealed. At this time, all the respective metallic foils 30A and 30B are buried in the pinch sealing portions 20*b*1 and 20*b*2 . However, front ends of the respective rod-shaped electrodes 26A and 26B protrude in the sealed glass sphere 20*a* so as to be opposite to each other from both sides in a cross direction. As a result, when the discharge bulb 10 is turned on, an arc 32, which curves upward, is generated between the front end portions of the rod-shaped electrodes 26A and 26B.

In addition, the discharge bulb 10 according to the present exemplary embodiment is composed of a mercury-free discharge bulb.

That is, an inert gas as a starting rare gas and metal halides are sealed in the closed glass sphere 20*a*, but mercury is not sealed.

At this time, the inert gas as the starting rare gas is sealed so as to allow the discharge to be easily generated between the front end portions of the rod-shaped electrodes 26A and 26B. In the present exemplary embodiment, a xenon (Xe) gas is used. In addition, the metal halides are sealed so as to enhance a light-emitting efficiency and the color rendering characteristic. In the present exemplary embodiment, sodium iodide and scandium iodide are used in this embodiment.

Further, the mercury has a buffer function for alleviating damage to the rod-shaped electrode 26A (or 26B) by reducing an amount of impact of electrons against the rod-shaped electrode 26A (or 26B). However, since the discharge bulb of the invention is made to be mercury-free, it becomes impossible to obtain this function. Accordingly, in the present exemplary embodiment, a buffering metal halide is sealed as a substitute of mercury for achieving the aforementioned buffer function. As this buffering metal halide, it is possible to use one kind or a plurality of kinds among halides of, for example, Al, Bi, Cr, Cs, Fe, Ga, In, Li, Mg, Ni, Nd, Sb, Sn, Ti, Tb, and Zn. In addition, an amount of sealed buffering metal halide is smaller than amounts of sealed sodium iodide and scandium iodide.

The inert gas forming a heat insulating space is sealed (filled) in the shroud glass tube 18 that surrounds the closed glass sphere 20*a* of the arc tube main body 20 in the arc tube 12. The pressure of a sealed inert gas (charging pressure) is set to a negative pressure of 0.2 to 0.9 atm (e.g., 0.5 atm or thereabouts).

The sealing of the shroud glass tube 18 with respect to the arc tube main body 20 is performed as follows: after welding a rear end portion 18*b* of the shroud glass tube 18 to the arc tube main body 20, the inert gas is filled in the shroud glass tube 18, and a front end portion 18*a* of the shroud glass tube 18 is subsequently welded to the arc tube main body 20. At this time, the welding of the front end portion 18*a* of the shroud glass tube 18 to the arc tube main body 20 is performed, for example, by shrink sealing.

In addition, the thermal conductivity $\lambda$(W/m·K) at the time of operation of the inert gas in the shroud glass tube 18 that surrounds the sealed glass sphere 20*a* of the arc tube main body 20 is adjusted such that it satisfies the condition formula $(X+0.42M-12)/160 \leqq \lambda \leqq (X+0.32M-6.5)/144$ with respect to the pressure X (atmospheric pressure) of a starting rare gas sealed in the closed glass sphere 20*a* and an amount M (mg/ml) of a sealed metal halide. Further, in this condition formula, the pressure X of a starting rare gas sealed in the closed glass sphere 20*a* is within a range of 10 to 15 atm and an amount M of a sealed metal halide is within a range of 10 to 20 mg/ml. Thereby, in the arc tube 12, a light flux of 2350 lumens or more is obtained. In addition, a life span of 2500 hours or more is ensured.

That is, as shown in FIGS. 3 to 6(*b*), there is a relationship in direct proportion to each other between the thermal conductivity of the inert gas sealed in the shroud glass tube 18 and the life span of the arc tube 12 (there is a relation ship in substantially inverse proportion to each other between the thermal conductivity of the inert gas and the light flux of the arc tube 12). In the meantime, it was confirmed that there is a relationship in inverse proportion to each other between an sealed in the closed glass sphere 20*a* and the life span of the arc tube 12 (there is a relation ship in direct proportion to each other between the amount of metal halide and the light flux). In addition, in the above-mentioned relationship, 2350 lumens and 2500 hours, which are necessary for a light flux and a life span of a mercury-free arc tube 12 for a vehicle headlamp, are set to an allowable limit (lower limit), as shown in FIGS. 7(*a*) to 7(*c*), the thermal conductivity $\lambda$(W/m·K) of the inert gas sealed in the shroud glass tube 18 at the time of operation becomes a value which satisfies the condition $(X+0.42M-12)/160 \leqq \lambda \leqq (X+0.32M-6.5)/144$ with respect to the pressure X (atmospheric pressure) of a starting rare gas sealed in the closed glass sphere and an amount M (mg/ml) of a sealed metal halide. That is, the thermal conductivity $\lambda$(W/m·K) at the time of operation of the inert gas sealed in the shroud glass tube 18 is adjusted so as to satisfy the above-mentioned condition formula, and a light flux of 2350 lumens or more and a life span of 2500 hours or more are ensured in the mercury-free arc tube 12.

An experimental result, which is obtained by considering and ensuring characteristics of an initial light flux and a life span of the arc tube 12 with respect to the thermal conductivity of the mixed gas (sealed inert gas), is illustrated in FIGS. 3 to 7(*c*). In the experiment, mercury-free arc tubes 12, in each of which the pressure of the starting rare gas sealed in the closed glass sphere 20*a* or the amount of the sealed metal halide are varied, and a mixed gas (sealed inert gas) sealed in the shroud glass tube 1 whose thermal conductivity is previously adjusted to various values by mixing a first inert gas of any one of Ar, Kr, and Xe, each of which has relatively low thermal conductivity, and a second inert gas of any one of He and Ne, each of which has relatively high thermal conductivity, are used.

Figure 4A:
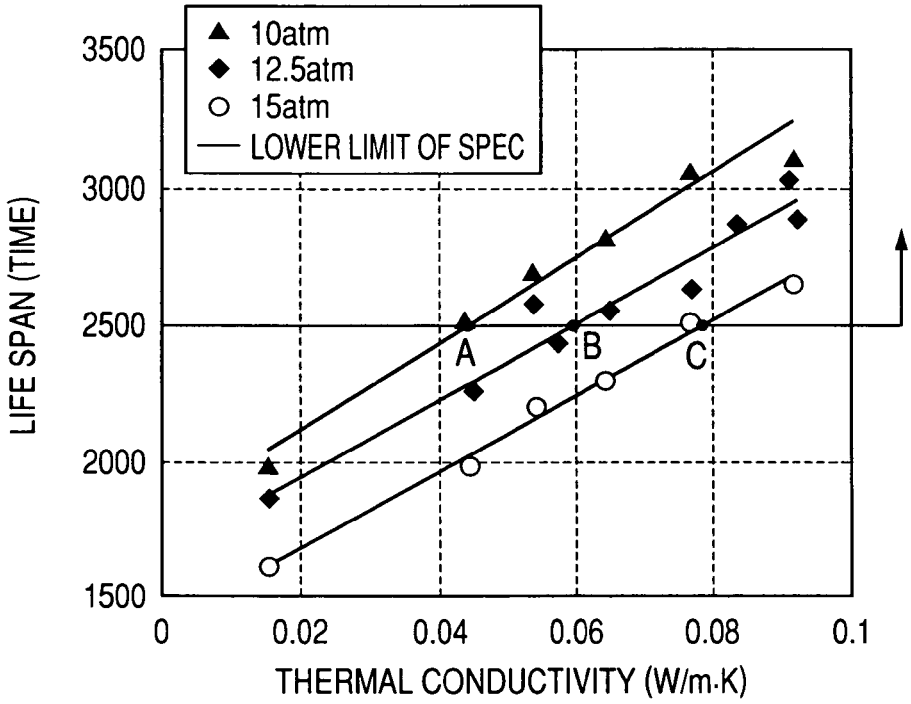
FIG. 4(*a*) is a graph illustrating the relationship of FIG. 3, and illustrating a relationship between the thermal conductivity of the inert gas sealed in the shroud glass tube and the life span.
Figure 4B:
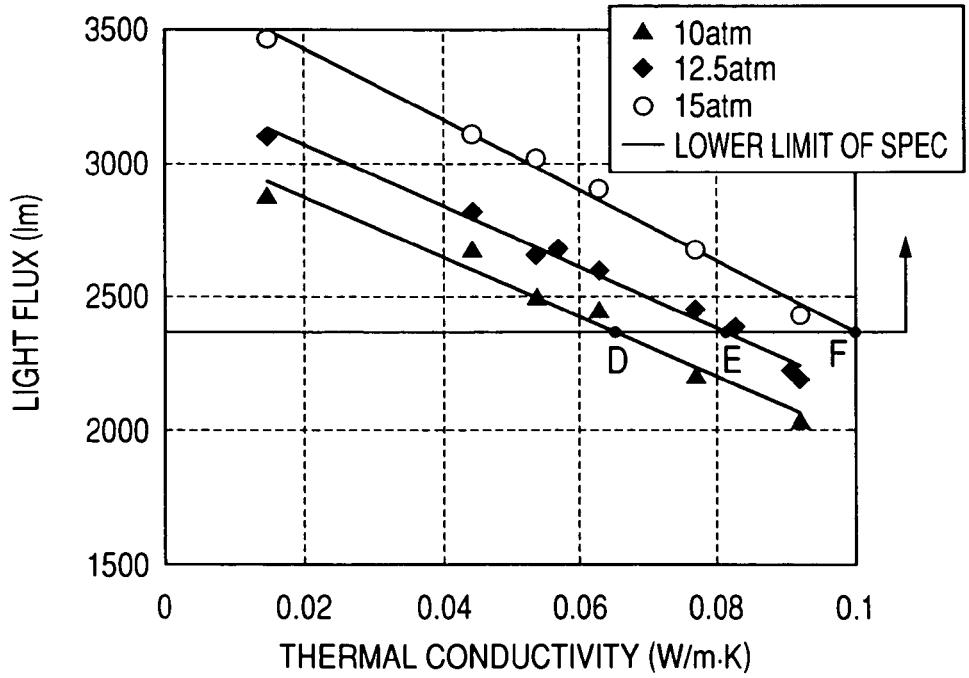

In FIGS. 3, 4(*a*) and 4(*b*), in a case in which an amount of metal halide sealed in the closed glass sphere 20*a* is 20 mg/ml and the pressure of the starting rare gas sealed in the closed glass sphere 20*a* is 10 atm, 12.5 atm, or 15 atm, an aspect where the life span or light flux of the arc tube 12 is varied with respect to the thermal conductivity of the inert gas sealed in the shroud glass tube 18 is illustrated. As shown in FIGS. 3 and 4(*a*), the thermal conductivity of the inert gas sealed in the shroud glass tube 18 is substantially in direct proportion to the life span of the arc tube 12, and if the pressure of the starting rare gas sealed in the closed glass sphere 20*a* is low (high), the life span of the arc tube 12 is long (short). As shown in FIGS. 3 and 4(*b*), the thermal conductivity of the inert gas sealed in the shroud glass tube 18 is substantially in inverse proportion to the light flux of the arc tube 12, and if the pressure of the starting rare gas sealed in the closed glass sphere 20*a* is high (low), the light flux is large (small).

Figure 6A:
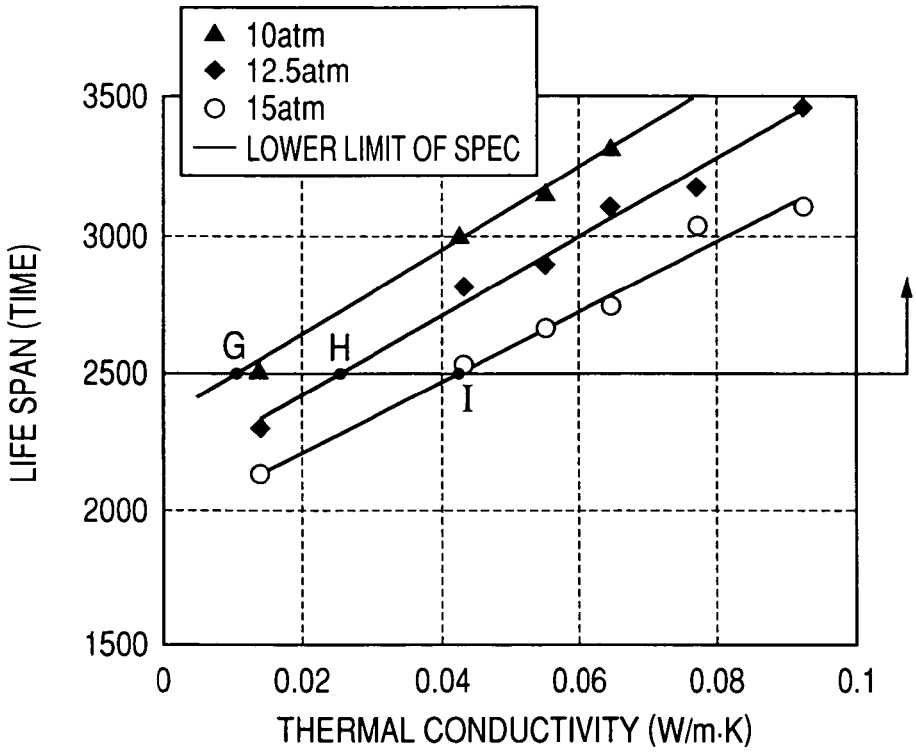
FIG. 6(*a*) is a graph illustrating the relationship of FIG. 5, and illustrating a relationship between the thermal conductivity of the inert gas sealed in the shroud glass tube and the life span.
Figure 6B:
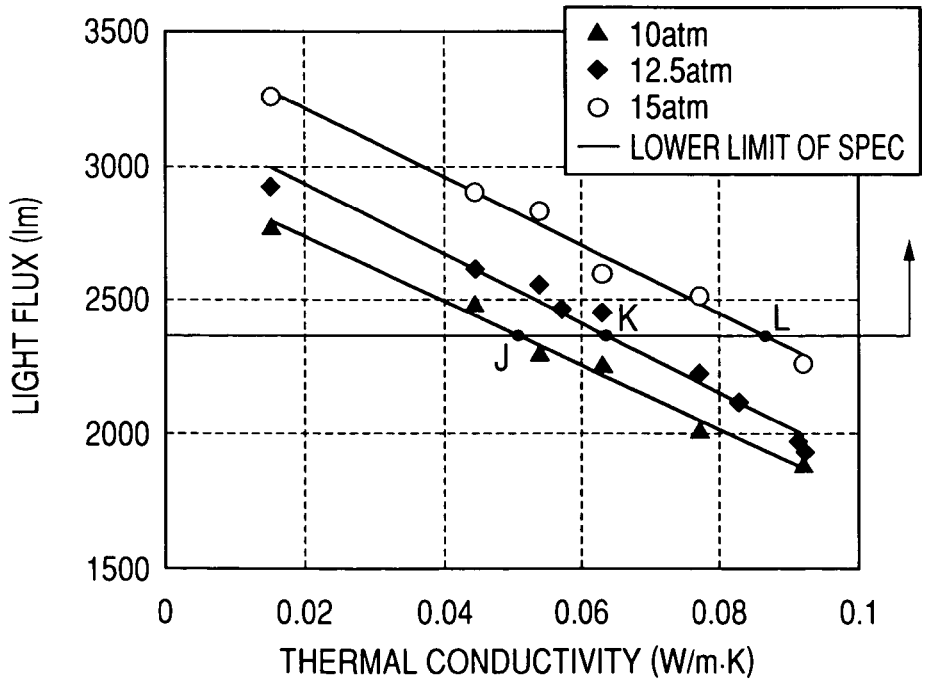
Figures 7A, 7B, 7C:
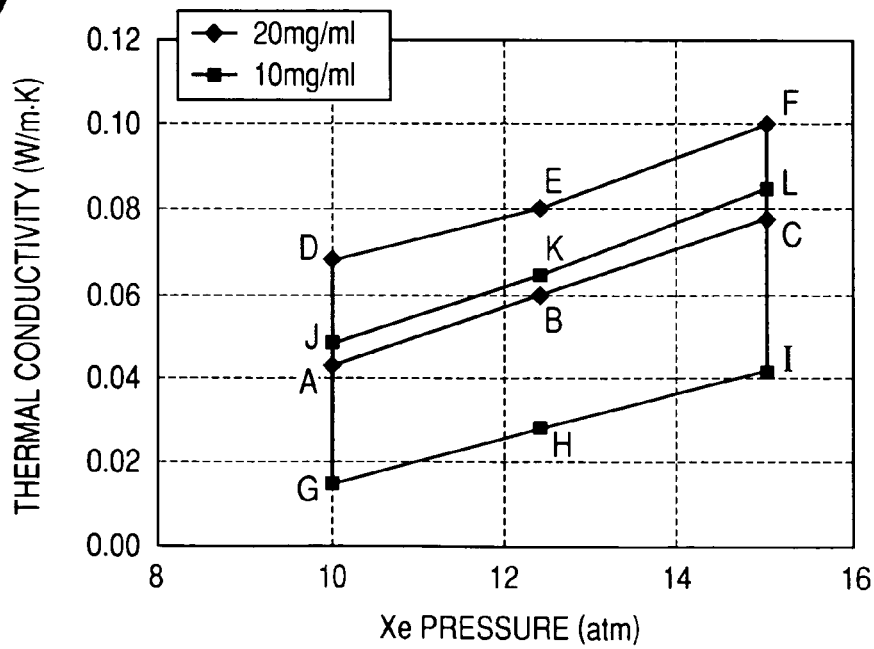
FIG. 7(*a*) is a diagram illustrating a predetermined range of the thermal conductivity of the inert gas sealed in the shroud glass tube with respect to the sealed pressure of an inert gas (Xe) being a starting rare gas sealed in the closed glass sphere and an amount of sealed metal halide, and illustrating an upper limit and a lower limit of the thermal conductivity of an inert gas sealed in the shroud glass tube when an amount of metal halide sealed in the closed glass sphere is 20 mg/ml.

In FIGS. 5, 6(*a*) and 6(*b*), in a case in which an amount of metal halide sealed in the closed glass sphere 20*a* is 10 mg/ml and the pressure of the starting rare gas sealed in the closed glass sphere 20*a* is 10 atm, 12.5 atm, or 15 atm, an aspect where the life span or light flux of the arc tube 12 is varied with respect to the thermal conductivity of the inert gas sealed in the shroud glass tube 18 is illustrated. As shown in FIGS. 5 and 6(*a*), the thermal conductivity of the inert gas sealed in the shroud glass tube 18 is substantially in direct proportion to the life span of the arc tube 12, and if the pressure of the starting rare gas sealed in the closed glass sphere 20*a* is low (high), the life span of the arc tube 12 is long (short). As shown in FIGS. 5 and 6(*b*), the thermal conductivity of the inert gas sealed in the shroud glass tube 18 is substantially in inverse proportion to the light flux of the arc tube 12, and if the pressure of the starting rare gas sealed in the closed glass sphere 20*a* is high (low), the light flux is large (small).

As shown in FIGS. 4(*a*), 4(*b*), 6(*a*) and 6(*b*), even though an amount of metal halide sealed in the closed glass sphere 20*a* is varied (10 mg/ml and 20 mg/ml), the characteristic that the thermal conductivity of the inert gas sealed in the shroud glass tube 18 is substantially in direct (inverse) proportion to the life span (light flux) of the arc tube 12 is not varied, but if the amount of the metal halide sealed in the closed glass sphere 20*a* is large (small), the life span of the arc tube 12 becomes short (lengthened), and the light flux increases (decreases). Further, if the pressure of the starting rare gas sealed in the closed glass sphere 20*a* is high (low), the life span becomes shortened (lengthened), and the light flux increases (decreases).

FIGS. 7(*a*) to 7(*c*) show a range of the thermal conductivity, with respect to the data shown in FIGS. 3 to 6(*b*), in which the light flux (life span) of the arc tube becomes 2350 lumens (2500 hours) or more, when an allowable limit (lower limit) of the light flux (life span) of the arc tube is set to the generally known 2350 lumens (2500 hours).

That is, when the amount of the metal halide sealed in the closed glass sphere is 20 mg/ml, in order to obtain the life span of the spec lower limits (points A, B, and C) or more in FIG. 4(*a*) showing the relationship between the thermal conductivity and the life span, the thermal conductivity is preferably the spec lower limits (points A, B, and C) or more. In addition, in order to obtain the light flux of the spec lower limits (points D, E, and F) or more in FIG. 4(*b*) showing the relationship between the thermal conductivity and the light flux, the thermal conductivity is preferably the spec lower limits (points D, E, and F) or less. Illustrated in FIG. 7(*c*) is a range of thermal conductivity of the inert gas sealed in the shroud glass tube 18 in which the light flux and the life span of the arc tube 12 become predetermined values (rectangular region surrounded by A, B, C, D, E, and F), when the amount of the metal halide sealed in the closed glass sphere 20*a* is 20 mg/ml.

In the same manner, when the amount of the metal halide sealed in the closed glass sphere is 10 mg/ml, in order to obtain the life span of the spec lower limits (points G, H, and I) or more in FIG. 6(*a*) showing the relationship between the thermal conductivity and the life span, the thermal conductivity is preferably the spec lower limits (points G, H, and I) or more. In addition, in order to obtain the light flux of the spec lower limits (points J, K, and L) or more in FIG. 6(*b*) showing the relationship between the thermal conductivity and the light flux, the thermal conductivity is preferably the spec lower limits (points J, K, and L) or less. Illustrated in FIG. 7(*c*) is a range of thermal conductivity of the inert gas sealed in the shroud glass tube 18 (rectangular range surrounded by G, H, I, J, K, and L) in which the light flux and the life span of the arc tube 12 become 2350 lumens or more and 2500 hours or more, respectively, when the amount of the metal halide sealed in the closed glass sphere 20*a* is 10 mg/ml.

In addition, in the region ABCDEF and the region GHIJKL, since the lower limit (ABC) in the region ABCDEF and the upper limit (JKL) in the region GHIJKL are overlapped and continuously increase in a vertical direction illustrating the thermal conductivity, when the amount of the metal halide sealed in the closed glass sphere is 10 to 20 mg/ml, a range of the thermal conductivity of the inert gas sealed in the shroud glass tube 18 in which the light flux and the life span of the arc tube 12 are respectively 2350 lumens or more and 2500 hours or more becomes a GHIDEF region in FIG. 7(*c*). In addition, the GHIDEF region, which specifies the thermal conductivity at the time of operation of the inert gas sealed in the shroud glass tube 18, can be represented by the condition formula $(X+0.42M-12)/160 \leqq \lambda \leqq (X+0.32M-6.5)/144$ where the pressure of the starting rare gas sealed in the closed glass sphere 20*a* set to X (atmospheric pressure) and the amount of the sealed metal halide is set to M (mg/ml). However, the data with respect to the amount of the metal halide sealed in the closed glass sphere 20*a* is limited to 10 to 20 mg/ml, as described above. In addition, the pressure X of the starting rare gas sealed in the closed glass sphere 20*a* is limited to 10 to 15 atm. When the pressure of the sealed starting rare gas is less than 10 atm, the initial light flux necessary for the light source of the lightlamp is not obtained. In addition, when the pressure of the sealed starting rare gas exceeds 15 atm, the crack may occur in the closed glass sphere 20*a* when the bulb is turned on. The pressure X of the starting rare gas for practical is 10 to 15 atm.

As such, in order to make the light flux and the life span of the arc tube 12 become 2350 lumens or more and 2500 hours or more for practical use, respectively, the thermal conductivity $\lambda$(W/m·K) at the time of operation of the inert gas sealed in the shroud glass tube 18 may be adjusted to the value which obtains the above-mentioned condition formula. Therefore, in the present embodiment, the thermal conductivity $\lambda$(W/m·K) at the time of operation of the inert gas sealed in the shroud glass tube 18 is adjusted to the value which obtains the above-mentioned condition formula on the basis of the pressure X (atmospheric pressure) of the starting rare gas sealed in the closed glass sphere 20*a* and the amount M of the sealed metal halide (mg/ml).

In addition, the sealed inert gas surrounding the closed glass sphere (heat insulating layer whose thermal conductivity is adjusted to a predetermined value on the basis of the above-mentioned condition formula) performs a first function and a second function. According to the first function, the sealed inert gas prevents the heat propagation from the closed glass sphere 20*a* serving as the discharge light-emitting portion to the shroud glass tube 18, and prevents the excessive thermal loss, and the light-emitting efficiency of the arc tube 12 becomes lowered, and prevents that the surface temperature of the shroud glass tube 18 excessively rises, and the surface becomes whitened. According to the second function, the sealed inert gas properly controls the heat propagation from the sealed glass sphere 20*a* serving as the discharge light-emitting portion to the shroud glass tube 18 and causes (allows) the heat to be properly irradiated, such that the occurrence of the flickering is prevented due to the excessive rise of the temperature in the closed glass sphere 20*a*. Therefore, it is possible to ensure the light flux and the life span for practical use.

In addition, a method of adjusting the thermal conductivity $\lambda$(W/m·K) at the time of operation of the inert gas sealed in the shroud glass tube 18 is as follows.

A gas of any kind of the first inert gases (Ar, Kr, and Xe), each of which has relatively lower thermal conductivity, and a gas of any kind of the second inert gases (He and Ne), each of which has relatively high thermal conductivity, are mixed at a predetermined ratio as shown in FIG. 3, and the mixed gas whose thermal conductivity is adjusted to the thermal conductivity $\lambda$ which satisfies the above-mentioned condition formula is prepared as the sealed inert gas. In a process of sealing the inert gas, the sealed inert gas whose thermal conductivity $\lambda$(W/m·K) is adjusted at the time of operation is sealed in the shroud glass tube 18.

As such, in the present exemplary embodiment, when the thermal conductivity $\lambda$(W/m·K) of the inert gas sealed in the shroud glass tube 18 at the time of operation is adjusted, the first inert gas whose thermal conductivity is relatively low is mixed with the second inert gas whose thermal conductivity is relatively high, and the thermal conductivity is adjusted. Therefore, as compared with cases when at least a single inert gas is mixed with the air or nitrogen so as to adjust the thermal conductivity, when a plurality of kinds of inert gases, each of which has relatively lower thermal conductivity, are mixed with each other so as to adjust the thermal conductivity, and when a plurality of kinds of inert gases, each of which has relatively higher thermal conductivity, are mixed with each other so as to adjust the thermal conductivity, the thermal conductivity of the mixed gas can be accurately and easily adjusted to a predetermined thermal conductivity.

In addition, the mercury-free arc tube 12 is constructed such that the relationship between the minute gap $\delta$1 between the shroud glass tube 18 and a lower portion of the closed glass sphere 20*a* and the minute gap δ2 between the shroud glass tube 18 and an upper portion of the closed glass sphere 20*a* satisfies the condition δ1≧δ2. As a result, a desired light flux is ensured.

That is, in the shroud glass tube, a maximum value of an outer diameter is determined in a standard (ECER99). In addition, since some inner thickness of the glass is necessary in order to ensure the strength, an inner diameter cannot be large. In the meantime, in the closed glass sphere which becomes a high temperature, it is necessary to increase an outer diameter so as to ensure durability. From this point of view, the gap between the closed glass sphere 20*a* and the shroud glass tube 18 is set to about 0.4 mm. In addition, the mercury-free arc tube 12 is manufactured in a state in which a center axis of the shroud glass tube 18 aligns with a discharge axis. However, in the process of manufacturing the arc tube 12, the center axis and the discharge axis of the shroud glass tube 18 do not align with each other, and thus may deviate from each other (the gap around the closed glass sphere 20*a* does not uniform in a circumferential direction). In addition, the arc tube 12, in which the center axis and the discharge axis of the shroud glass tube 18 deviate from each other, is installed in the insulating plug unit 14 so as to form the discharge bulb 12. When the discharge axis deviates from the center axis of the shroud glass tube 18 in a downward direction of the center axis (when the center axis of the closed glass sphere 20*a* deviates downward from the center axis of the shroud glass tube 18, and thus the minute gap δ1 between the shroud glass tube 18 and a lower portion of the closed glass sphere 20*a* is smaller than the minute gap δ2 between the shroud glass tube 18 and an upper portion of the closed glass sphere 20*a*), there is a problem in that the light flux of the arc tube 12 becomes lowered. The reason why the light flux of the arc tube 12 becomes lowered is considered as follows. That is, in the large heat insulating space above the closed glass sphere 20*a* (minute gap δ2), the heat propagation from the closed glass sphere 20*a* to the shroud glass tube 18 is suppressed. In contrast, in the small heat insulating space below the closed glass sphere 20*a* (minute gap δ1), the heat propagation from the closed glass sphere 20*a* to the shroud glass tube 18 is accelerated. As a result, since radiation of the heat is accelerated from the lower region of the shroud glass tube 18, the temperature of the cold point in the closed glass sphere 20*a* rises and the vapor pressure rises, which results in increasing a light flux.

Therefore, in the present exemplary embodiment in which the minute gap δ1 between the shroud glass tube 18 and a lower portion of the closed glass sphere 20*a* is larger than the minute gap δ2 between the shroud glass tube 18 and an upper portion of the closed glass sphere 20*a* (δ1≧δ2), as compared of a case of the minute gap δ1< the minute gap δ2, the heat propagation is suppressed in the small heat insulating space below the closed glass sphere 20*a* (minute gap δ1), and the radiation of the heat is suppressed from the lower region of the shroud glass tube 18. As a result, the temperature of the cold point in the closed glass sphere 20*a* rises and the vapor pressure rises, which results in rising a light flux.

In addition, since the arc generated between the electrodes 26A and 26B curves upward, thermal expansion increases at the upper side of the closed glass sphere 20*a* which becomes the high temperature. In a mercury-contained arc tube in which the mercury is sealed in the closed glass sphere, since the inside of the closed glass sphere becomes high temperature even at the low temperature. Therefore, in a case of δ1>δ2, the upper portion of the expanded closed glass sphere may interfere with the shroud glass tube so as to be broken. However, since the pressure of the inside of the closed glass sphere 20*a* of the mercury-free arc tube 12 is about half the pressure of the inside of the closed glass sphere of the mercury-contained arc tube, even though, for example, the minute gaps satisfy the condition δ1>δ2, there is no concern in that the upper portion of the closed glass sphere 20*a* interferes with the shroud glass tube 18 so as to be broken.

As described above, in the shroud glass tube 18, the mixed gas is sealed in which the first inert gas of any one of Ar, Kr, and Xe, each of which has relatively low thermal conductivity at the time of operation, and the second inert gas of any one of He and Ne, each of which has relatively high thermal conductivity at the time of operation, are mixed. However, when He is used as the mixed gas (sealed inert gas) in the shroud glass tube 18, the checking of the leakage from the shroud glass tube 18 (detects whether He leaks from the shroud glass tube 18) can be made by using a He leakage detector.

In addition, in the present embodiment, since a mixed gas between any one of Ar, Kr, and Xe and any one of He and Ne is filled (sealed) in the shroud glass tube 18, an auxiliary discharging effect through the gas in the shroud glass tube 18 (that is, an effect in which a starting voltage of the discharge bulb 10 is reduced by a photoelectric effect to a discharge electrode by the ultraviolet ray that is generated by the discharge in the space between the closed glass sphere 20*a* and the shroud glass tube 18 before starting the discharge in the closed glass sphere 20*a*).

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A mercury-free arc tube for a discharge bulb comprising:

a mercury-free arc tube main body including a closed glass sphere, wherein electrodes are oppositely provided and starting rare gases and metal halides are sealed in the closed glass sphere; and a cylindrical shroud glass tube that is airtightly integrated with the arc tube main body and surrounds the closed glass sphere, wherein an inert gas is sealed in the shroud glass tube surrounding the closed glass sphere, wherein the starting rare gas is sealed in the closed glass sphere in a pressure X within a range of 10 to 15 atm, and an amount M of sealed metal halide in the closed glass sphere is within a range of 10 to 20 mg/ml, the inert gas in the shroud glass tube is a mixed gas of a first inert gas and a second inert gas, and a thermal conductivity λ(W/m·K) of the mixed gas is adjusted within a range of a formula of $$(X+0.42M-12)/160 \leqq \lambda \leqq (X+0.32M-6.5)/144.$$

2. The mercury-free arc tube according to claim 1, wherein the first inert gas comprises one of Ar, Kr, and Xe, and the second inert gas comprises one of He and Ne.

3. The mercury-free arc tube according to claim 1, wherein the first inert gas has relatively low thermal conductivity and the second inert gas has relatively high thermal conductivity.

4. The mercury-free arc tube according to claim 1, wherein a gap between a lower portion of the closed glass sphere and the shroud glass tube is the same as or larger than a gap between an upper portion of the closed glass sphere and the shroud glass tube.

* * * * *